US007101010B2

(12) United States Patent
Holstun et al.

(10) Patent No.: US 7,101,010 B2
(45) Date of Patent: Sep. 5, 2006

(54) PRINTHEAD SWATH TEMPERATURE CONTROL

(75) Inventors: Clayton L. Holstun, San Marcos, CA (US); Dustin W. Blair, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 244 days.

(21) Appl. No.: 10/691,190

(22) Filed: Oct. 22, 2003

(65) Prior Publication Data

US 2005/0088473 A1 Apr. 28, 2005

(51) Int. Cl.
*B41J 29/38* (2006.01)
*B41J 29/393* (2006.01)

(52) U.S. Cl. ..... 347/17; 347/14; 347/19

(58) Field of Classification Search ..... 347/17, 347/41

See application file for complete search history.

(56) References Cited

U.S. PATENT DOCUMENTS 5,353,052 A * 10/1994 Suzuki et al. ..... 347/19
6,527,355 B1 * 3/2003 Yang et al. ..... 347/14
6,871,929 B1 * 3/2005 Crivelli et al. ..... 347/17

* cited by examiner

*Primary Examiner*—Vip Patel
*Assistant Examiner*—Jannelle M. Lebron

(57) ABSTRACT

In one embodiment, a printing system includes an inkjet printhead configured to traverse bi directionally over a printzone printing one swath in a first direction, and a subsequent swath in a second direction opposite the first direction, with the printhead rising to a base temperature in response to a pre warming signal prior to beginning a swath. The printing system also includes a temperature sensor configured to monitor the temperature of the printhead. A controller is configured to generate the pre warming signal in response to an end of swath temperature monitored by the temperature sensor following printing the one swath.

21 Claims, 5 Drawing Sheets

PRINTHEAD SWATH TEMPERATURE CONTROL

BACKGROUND

Inkjet printheads typically move across print media depositing ink droplets one swath at a time to form a desired image, often in a bi-directional print mode, depositing ink when traveling to the right and then on the return path when traveling to the left, for example. During a print swath, the temperature of a thermal inkjet printhead rises, resulting in larger ink droplets having a higher drop weight being emitted near the end of a swath, appearing as an optical density or color saturation change across the swath.

During the turnaround time between print swaths, the printhead is allowed to cool to preserve printhead life, so on the beginning the next swath a lower drop weight is emitted from the cooled printhead and the image appears lighter than the previous swath. This printhead temperature ramp phenomenon produces a print quality artifact known as "banding," which is particularly noticeable in bi-directional monochromatic printing where an alternating pattern of light and dark bands appear down each edge of the printed image.

SUMMARY

In one embodiment, a printing system includes an inkjet printhead configured to traverse bi-directionally over a print-zone printing one swath in a first direction, and a subsequent swath in a second direction opposite the first direction, with the printhead rising to a base temperature in response to a pre-warming signal prior to beginning a swath. The printing system also includes a temperature sensor configured to monitor the temperature of the printhead. A controller is configured to generate the pre-warming signal in response to an end of swath temperature monitored by the temperature sensor following printing the one swath.

DETAILED DESCRIPTION OF THE PREFERRED EMBODIMENTS

In the following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview

Figure 1:
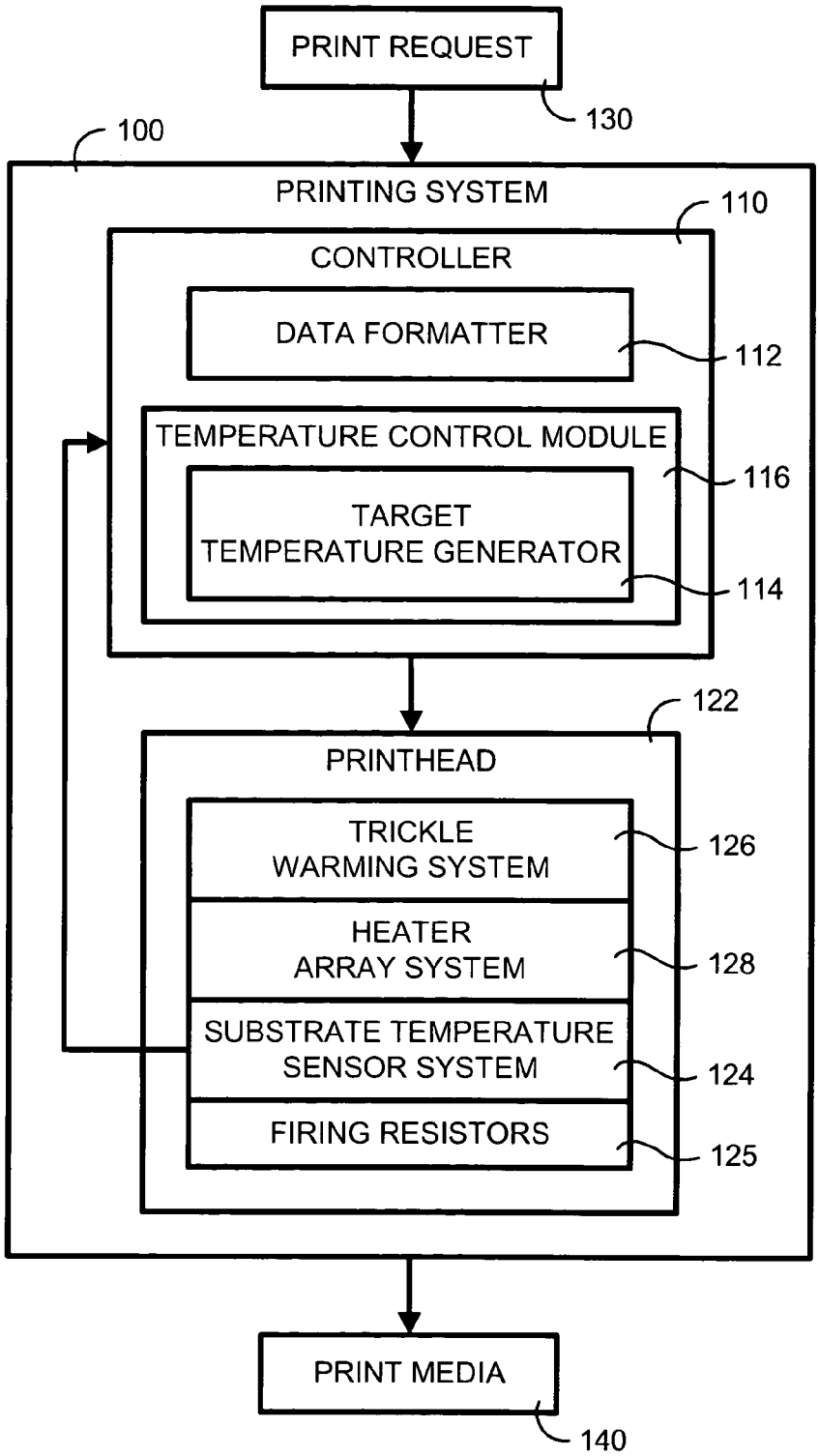
FIG. 1 is a block diagram showing one embodiment of the present invention.

FIG. 1 is a block diagram showing one embodiment of the present invention for use with a printing system 100, which includes a controller 110. The controller 110 includes a data formatter 112 and a target temperature generator 114, which forms a portion of a temperature control module 116. The printing system 100 also includes a printhead 122, often referred to in the art as a "pen," which has a series of ink-ejecting nozzles, discussed further below with respect to FIG. 3. The illustrated printhead 122 is a thermal inkjet printhead which has a substrate including a temperature sensor system 124 which monitors the printhead temperature and then provides feedback communication to the temperature control module 116.

The printhead 122 also has at least one firing resistor 125 located adjacent to an ejection chamber associated with each nozzle. Each firing resistor 125 is selectively energized to heat ink in the associated ejection chamber to a boiling point, which forces an ink droplet to be ejected through the associated nozzle. As mentioned briefly in the Background section above, this heat level affects the amount of ink ejected and the size of the resulting droplet, a phenomenon which is studied by referring to the resulting "drop weight" of the ejected droplet. To eject ink droplets, the printhead 122 may operate in response to a trickle warming system 126 which pre-warms or pre-heats the ink prior to ejection and a heater array system 128 which may comprise one or more of the firing resistors 125.

In general, a user or operator initiates a print request 130 to the printing system 100, which is received by the printer controller 110. The print request 130 typically includes printer command language and print data which describes an image to be produced on a print media 140, for example paper, fabric, poster board, etc. The data formatter 112 may include a pixel generator module that translates the print data of request 130 by converting rows of raster data for each printhead swath into columns of pen firing data that conform to columns of ink ejecting nozzles in the printhead 122, discussed further below with respect to FIG. 3. This pen firing data may be converted by formatter 112 into firing control signals which may take the form of current pulses fed firing resistors 125 of printhead 122.

The temperature of the printhead 122 may be frequently sensed by the substrate temperature sensor system 124, including for instance a temperature sensing resistor, which may be incorporated into the printhead substrate containing the firing resistors 125 and related circuitry. In one embodiment, analog temperature data from the sensor system 124 may be suitably amplified and converted to provide digital signals to the temperature control module 116 of controller 110. The temperature control module 116 may sample the printhead temperature, for example at the end of a print swath, which may then be used to compute a start temperature for the next print swath. If the present operating temperature of the printhead 122 is below a threshold temperature, the pen firing data from request 130 may also be fed to the temperature control module 116 to provide control signals to initiate operation of the trickle warming system 126 for the firing resistors. The trickle warming system 126, with input from the data formatter 112, may pre-warm the firing resistors 125 or a separate heater array system 128 with low current pulses below a firing threshold, increasing a baseline temperature of the substrate associated the firing resistors 125.

The trickle warming system 126 may be activated by the data formatter 112 and may be a plural mechanism according to the desire to print a particular color or colors. The illustrated warming system 126 may be divided into color coded sections that lie as close as possible to the associated resistors in the printhead 122. The firing resistors 125 associated with the warming devices may be switched on by conventional combinations of the firing of the address decode, address and data decodes, as well as by an "and" block and a level shifter. Further, the determination of whether a nozzle has been selected as a data receiver is based on whether the address in a primitive portion of the device matches the address of trickle warmer 126.

II. Printing System

Figure 2:
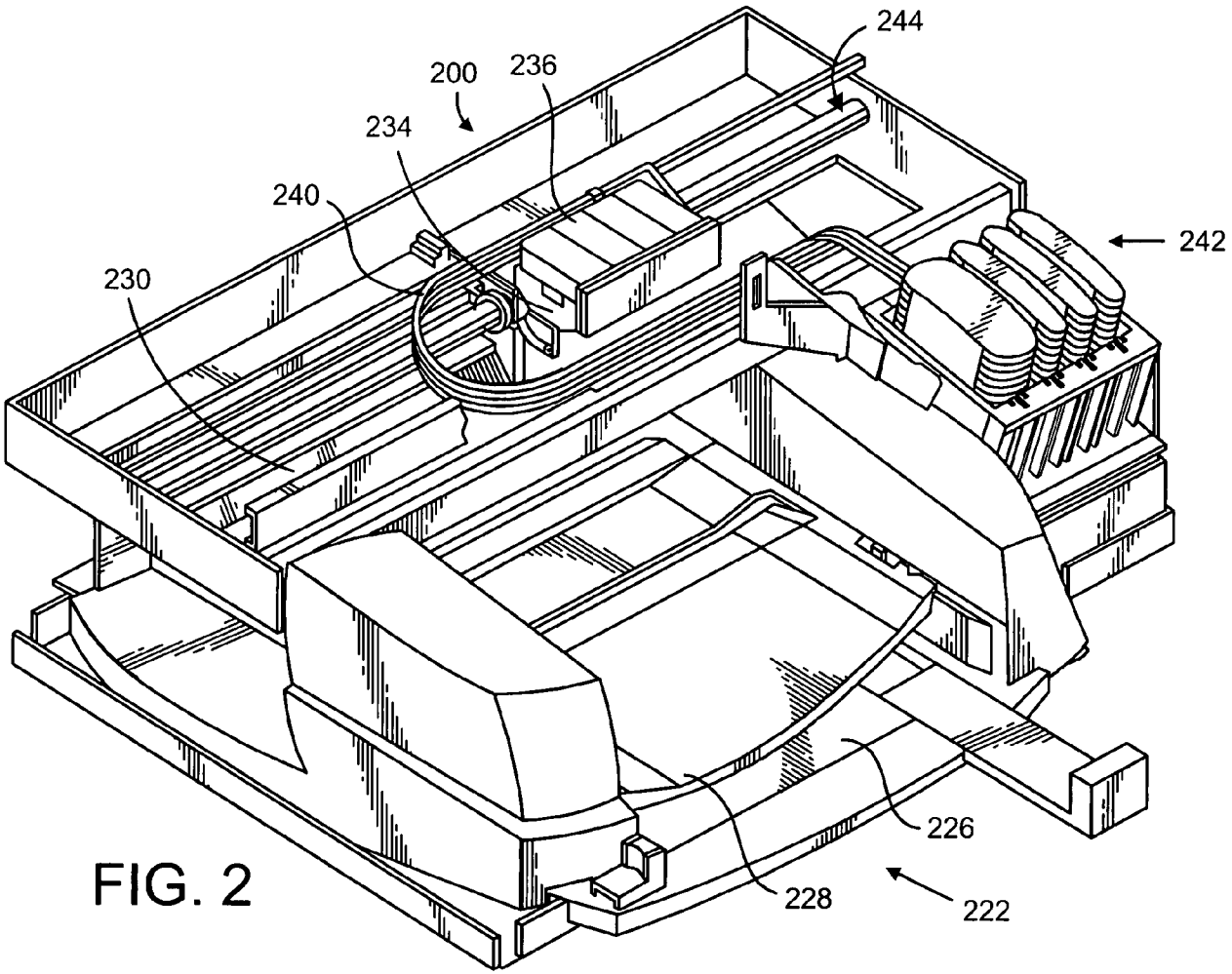
FIG. 2 is a perspective view of one embodiment showing an exemplary inkjet printing mechanism, here a printer that incorporates one embodiment of the invention which is shown for illustrative purposes only.

FIG. 2 is a perspective view of an exemplary printing system, here shown as an inkjet printer 200 for illustrative purposes only, which incorporates printing system 100 of FIG. 1. The printer 200 includes a media handling system 222 having an input media supply tray 226 and an output tray 228 which receives media following printing in a printzone 230. The print media, such as paper, may be advanced from the supply tray 226 and through the printzone 230 using conventional elastomeric driver rollers, for example. A reciprocating carriage assembly 234 transports several ink-jet printheads 122, each associated with a print cartridge, such as cartridge 236. The illustrated printer 200 is known in the art as an "off-axis" printer because each of the cartridges 236 receives fresh ink via flexible tubing 240 from stationary remote ink supplies 242. The illustrated carriage assembly 234 moves back and forth horizontally (to the left and right in FIG. 2) across printzone 230 while sliding along a carriage guide rod 244, although other orientations may be employed in different implementations.

While an off-axis printer 200 is illustrated, it is apparent that other systems may be employed, such as those having replaceable ink-jet cartridges which carry their entire ink supply across printzone 230, or "snapper" cartridge systems which employ permanent or semi-permanent printheads having replaceable ink supplies which are snapped onto the printheads. The printing system 100 may also be used in alternative printing systems (not shown) such as large format plotters, or high-speed printers using grit wheel or drum technology to support and move print media through the printzone.

Figure 3:
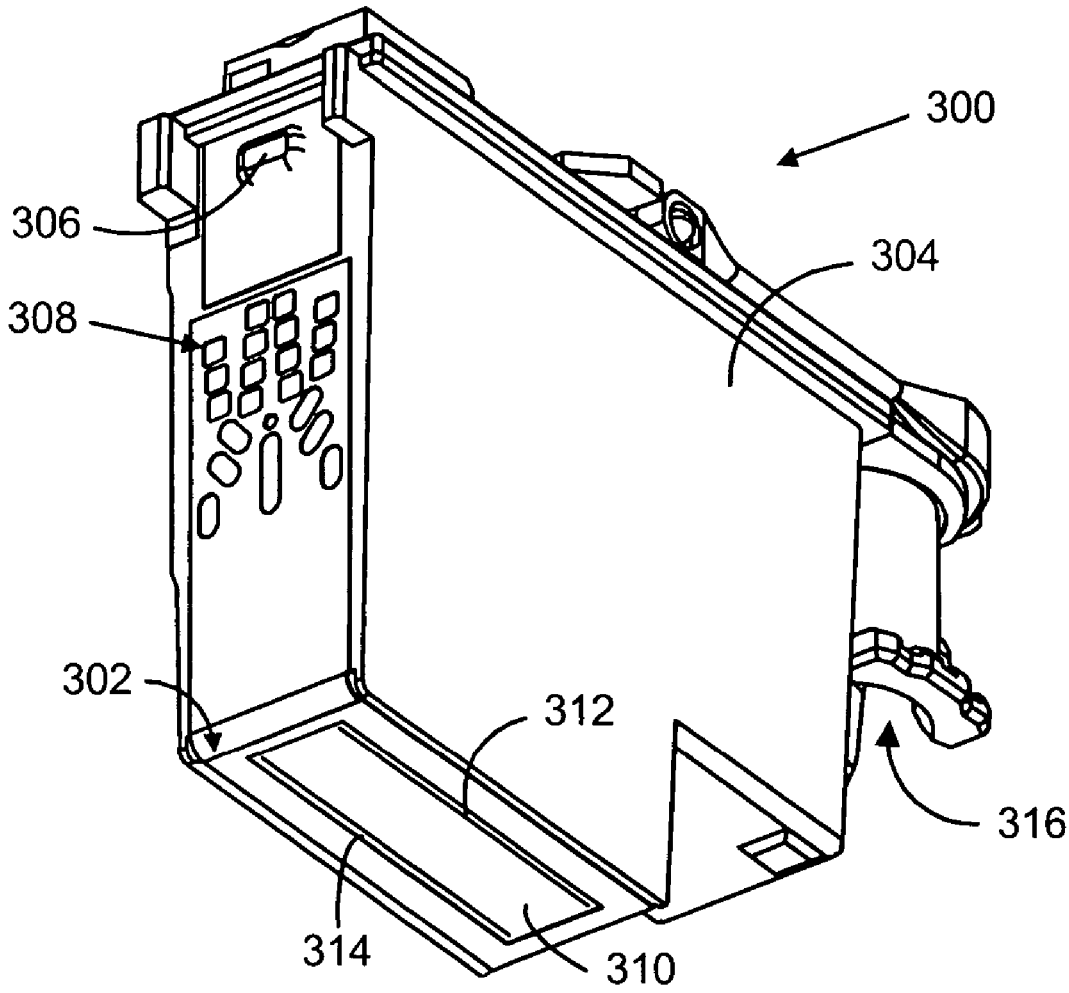
FIG. 3 is a perspective view shown for illustrative purposes only of an embodiment of an exemplary print cartridge incorporating the present invention.

FIG. 3 shows for illustrative purposes only a perspective view of an exemplary inkjet cartridge 300, including an example of the printhead assembly 122 of FIG. 1, used in the printer 200 of FIG. 2; however, the printing system 100 of FIG. 1 may be incorporated in any printhead and printer configuration, as mentioned above. The illustrated cartridge 300 includes a thermal inkjet printhead assembly 302 supported by a body 304 which defines a small ink reservoir therein. The body 304 has several alignment datums, such as datum 306, which may be aligned with conventional datums (not shown) of carriage 234 when cartridge 300 is installed. The cartridge 300 also includes a group of electrical interconnect pads 308 which may be coupled with conventional electrical interconnects (not shown) of carriage 234 when cartridge 300 is installed for communication between the printhead 302 and controller 110 of FIG. 1.

The printhead assembly 302 includes an orifice plate 310, which defines a series of ink ejecting nozzles, illustrated in FIG. 3 as being arranged in two linear arrays 312 and 314 which may be constructed by, for example, laser ablation. The term "linear" is used generally with respect to arrays 312, 314 because in some embodiments, the nozzles may be arranged in a slightly offset or staggered pattern, while in other implementations other nozzle arrangements may be more suitable. As mentioned above, ink is received from the off-axis stationary reservoirs 242 and delivered via flexible to tubing 240 to an ink inlet port, indicated generally at item number 316 in FIG. 3, and is stored within the reservoir defined by body 304 prior to ejection from the nozzles of arrays 312, 314. An on-board integrated circuit chip (not shown) may provide feedback to the printer 200 regarding certain parameters of the printhead assembly 300, including information from the substrate temperature sensor system 124 of FIG. 1.

III. Detailed Description of the Components and Operation

Figure 4:
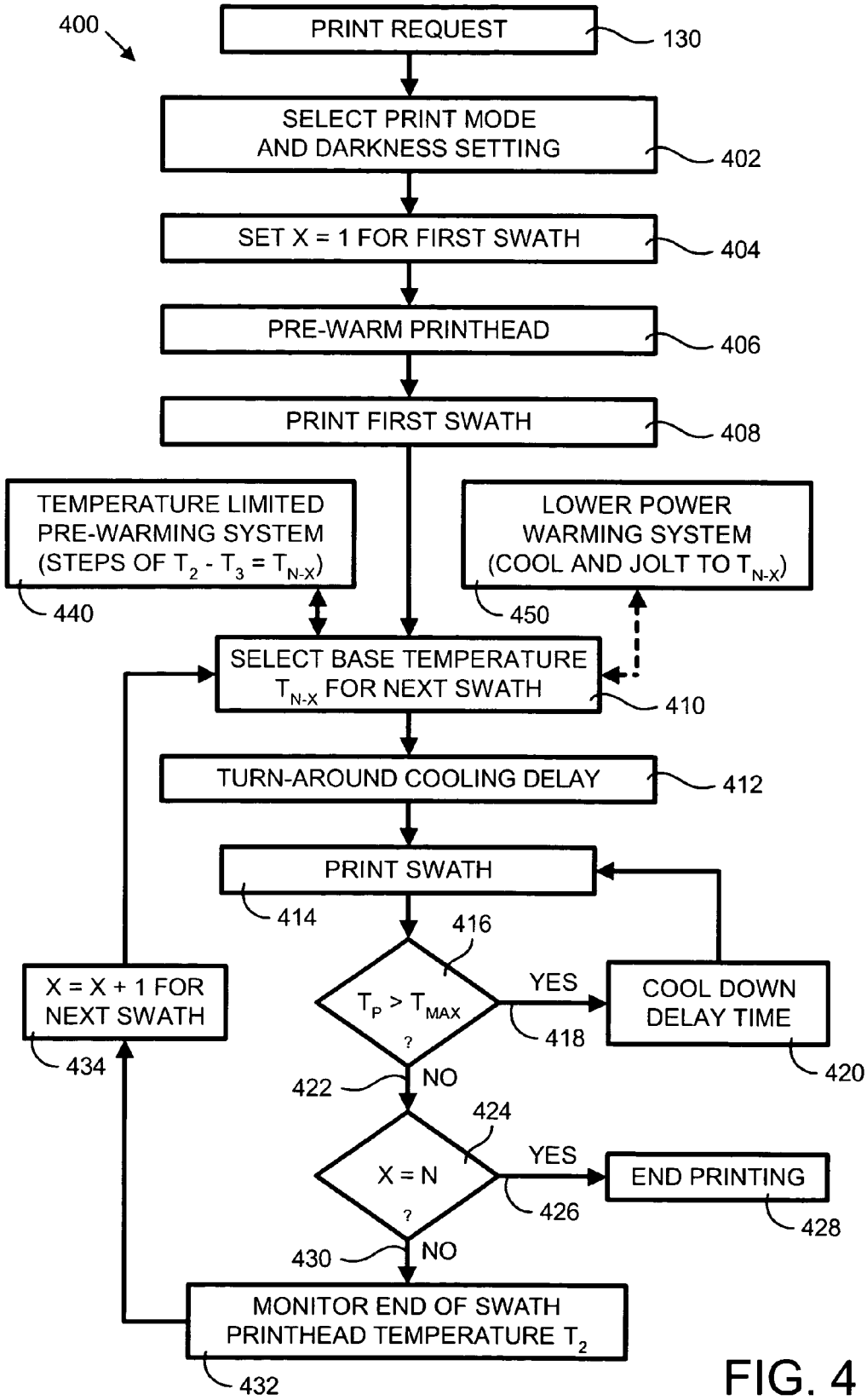
FIG. 4 is a flow chart showing two alternate embodiments of the present invention.

FIG. 4 is a flow chart 400 and each showing two alternative embodiments of the operation of the embodiment in FIGS. 1 through 3, which operates upon a user or operator initiation of print request 130. Optionally, a user may select a print mode and darkness setting in operation 402, or default settings may be preprogrammed into the printer 200 and/or controller 110. For instance, the print mode selected in operation 402 may be a one directional print mode or a bi-directional print mode, as well as a desired print quality, for instance, "draft," "normal" or "best." This may be accomplished in any suitable manner, such as by accessing an input keypad of the printer or a user interface of a printer driver, typically stored on a computer coupled to the printer. Other input criteria of operation 402 may include media size, media type, color, etc.

For the first print swath of the print request or print job 130, the variable X is set to one (X=1) in operation 404, and in operation 406 the printhead is pre-warmed to an initial trickle warming base temperature or pre-warming temperature $T_1$, which may be selected based upon the selected print mode and darkness selection operation 402. Optionally, pre-warming operation 406, and other temperature selection operations discussed further below, may also use a look ahead capacity to preview the data analyzed in the controller data formatter 112 (FIG. 1). For example, the controller 110 may analyze the print data for an upcoming print swath to develop the intensity and color information about the upcoming swath's content. The controller 110 may then categorize the print data according to pre-selected categorization temperature criteria within a set temperature range for each printhead 122. Several different types of pre-warming or base temperature selection criteria systems are discussed in further detail below.

As mentioned above, the pre-warming operation may be accomplished through the trickle warming system 126, a separate heater array system 128, or by providing current pulses to the firing resistors 125. The temperature of the printhead is then monitored by the substrate temperature sensor system or TSR's 124 for feedback to a temperature control module 116 of the controller 110. After reaching a selected pre-warming temperature $T_1$ in operation 406, the first swath may be printed according to operation 408.

Following printing of the first swath in operation 408, a selection of a base temperature for beginning of the next swath is made in operation 410. At this point, an optional operation of checking an end of swath printhead temperature $T_2$ may be made as discussed further below for later swaths, but for the purposes of discussion, the end of first swath temperature will be assumed to be a constant value, although it is apparent that this value is based upon averages and may vary in practice given the particular print job involved.

Before printing the next swath, a base or beginning temperature $T_{N-X}$ is selected in operation 410. Examples of the various criteria for dynamically selecting the base temperature are described in further detail below, following an overview of FIG. 4. After the base temperature selection of operation 410, a turnaround cooling delay operation 412 occurs, where the printhead carriage 234 has completed one print swath, and in a bi-directional (back and forth) print mode, needs to stop and then go back in the opposite direction across the printzone 230 to print the next swath. During this turnaround time, as discussed in further in detail below with respect to FIGS. 5A-5C, since the printheads 122 are not printing they begin to cool down, and the target temperature generator 114 (FIG. 1) implements the base temperature $T_{N-X}$ selection of operation 410 before beginning printing of the next swath in operation 414.

During the swath printing of operation 414, the printhead temperature during printing $T_P$ is analyzed in an overheating check operation 416 to determine whether overheating has occurred and whether the printhead temperature has exceeded a maximum temperature value $T_{MAX}$ ($T_P > T_{MAX}$). If the printhead temperature has exceeded a maximum value, a YES signal 418 is issued to a cool down delay time operation 420 which ceases printing until the printhead temperature $T_P$ has reached an acceptable value (which may be less than $T_{MAX}$) to continue printing. The substrate temperature sensor system 124 provides this $T_P$ temperature feedback to controller 110.

If the printing temperature $T_P$ remains under the maximum value $T_{MAX}$, then a NO signal 422 is issued from the overheating check operation 416, and following completion of swath printing operation 414, a determination is made at 424 as to whether the last print swath denoted by variable "N" has been printed (when X=N). If so, a YES signal 426 is issued to an end printing operation 428, and printheads 122 may be returned to a conventional printhead service station for servicing, and capping (hermetically sealing) to await the next print request 130. If the particular print swath X does not correspond to the last print swath N and more swaths need to be printed, then a NO signal 430 is issued to a monitoring operation 432.

In operation 432, an end of swath printhead temperature $T_2$ is monitored by the substrate temperature sensor system 124 and provided to the target temperature generator 114 (FIG. 1). So the system may recognize in a flowchart fashion that the next swath is being initiated, operation 434 occurs where the swath variable X is incremented by one (X=X+1), and the system returns to select another base temperature $T_{N-X}$ for the next swath in operation 410. Now the manner for selecting the base temperature $T_{N-X}$ for the next swath will be discussed with respect to two different embodiments, one entitled a Temperature Limited Pre-Warming System 440 shown with a solid double headed arrow in FIG. 4, and the other entitled a Lower Power Warming System 450 shown as an alternative embodiment by a dashed double headed arrow in FIG. 4. The double headed arrows indicate communication between the selecting base temperature operation 410 and the alternative operations 440 and 450 which determine the next swath base temperature $T_{N-X}$ selected.

The end of swath temperature $T_2$ may be used to calculate a starting base temperature for the next or subsequent swath $T_{N-X}$ (where "X" denotes the current print swath, and "N" denotes to total number of print swaths of print request 130, so when X=N, the print job is concluded) by deducting a selected cooling temperature $T_3$ from the end of swath temperature $T_2$:

$$T_{N-X}=T_2-T_3.$$

This cool down occurs during the turnaround time 412 before beginning to print the next swath, with the printhead temperature being monitored by the substrate sensors 124. If required, optionally the trickle warming system 126 may warm the pen to the new starting temperature $T_{N-X}$. The next swath is then printed in operation 414, with a decreased ramp effect to control the banding phenomenon as described further below due to the controlled selection of the new starting temperature $T_{N-X}$.

As mentioned above in the Background section, a noticeable print quality artifact known as "banding" occurs during one pass, bi-directional print modes due to the ramp phenomenon, where as the printhead temperature increases during a print swath, the drop weight also increases. For a high density monochromatic image, the magnitude of this increase in temperature across the swath is dependent upon the starting or pre-warming trickle base temperature at the beginning of the swath (initially $T_1$, and thereafter $T_{N-X}$). Table 1 shows various pre-warming temperatures, the temperature excursion during a single print swath from the pre-warming temperature (all in degrees Celsius), and the resulting percentage of change in drop weight for cyan ink, as an example.

TABLE 1

PRE-WARMING TEMPERATURE AFFECTS

| Pre-Warming Temp. | Swath Change | Drop Weight Change |
|---|---|---|
| 55° C. | 5° C. | 7.5% |
| 60° C. | 4° C. | 6% |
| 65° C. | 3° C. | 4.5% |
| 70° C. | 2° C. | 3% |
| 75° C. | 1° C. | 1.5% |

Thus, for every 5° C. increase in the target pen pre-warming temperature, the temperature change from the beginning to end of each print swath decreases by about 1° C., with each 1° C. change in temperature corresponding to about a 1.5% change in drop weight.

While one simple-minded solution to the banding problem may be to simply drive the pre-warming temperature up to 70° C. or 75° C. for a minimal drop weight change, such high operating temperatures may shorten pen lifetime, decrease pen reliability, or result in other print quality defects. Furthermore, if the maximum operating temperature is exceeded, printers are typically programmed to delay printing until the printhead cools down, as shown in operation 420, a process which slows the throughput (typically measured in terms of "pages per minute") of the printer. Another earlier approach allows each pen to cool down from the end of swath temperature of 60° C. (=55° C.+5° C.) to the trickle pre-warming temperature of 55° C. before beginning the next print swath, but the resulting 7.5% change in drop weight produces the visually noticeable banding artifact which we are trying to avoid. In the following discussion of our new approaches, this earlier approach (beginning of swath or base temperature of 55° C.) will be referred to as the "Default Case."

A. Temperature Limited Warming System

Rather than using the Default Case warming system, a Rule-Based pen warming system may be used. A Rule-Based pen warming system is a system that has a predefined set of operating rules. Referring back to Table 1, with an initial pre-warming temperature of 55° C., the temperature at the end of the first swath is $T_2$=60° C. (=55° C. initial+5° C. change). If the cooling temperature $T_3$ is selected to be less than the 5° C. change of the Default Case, the drop weight change from the end of the previously printed swath to the beginning of the next swath is less, to decrease the noticeable effects of banding. For instance, if each printhead was allowed to cool in a smaller step increment, for instance by 2° C. (=$T_3$), the starting temperature of the next swath would be 58° C. (=$T_{N-X}$), rather than the 55° C. of the default case, resulting in about a 3% change in drop weight between the end of the previous swath and the beginning of the next swath. This 3% change in drop weight is about 40% of the change experienced in the default case (7.5% change), resulting in far less noticeable color differences between adjacent swaths at the edges of a printed document, producing a significant reduction in banding print artifacts. Continuing this Step-up procedure for increasing the base temperature of printheads 122 prior to each swath eventually leads to a higher printhead temperature at the conclusion of a print job, as shown below in Table 2, but the print quality is significantly enhanced.

Table 2 shows the temperature changes with the Temperature Limited Warming System during a twelve pass (swath) print job, including the starting temperature, the ending temperature, the temperature change ("Delta Temp." with both maximums and minimums shown) and the print direction for each swath (shown by arrows). Table 3 shows similar data for the Default Case (beginning of swath or base temperature of 55° C.).

TABLE 2

TEMPERATURE LIMITED WARMING SYSTEM

| Start Temp. | End Temp. | Delta Temp. | | Direction |
|---|---|---|---|---|
| 55.0 | 60.0 | Max. | Min. | => |
| 58.0 | 62.4 | 7.4 | 2.0 | <= |
| 60.4 | 64.3 | 6.3 | 2.0 | => |
| 62.3 | 65.9 | 5.5 | 2.0 | <= |
| 63.9 | 67.1 | 4.8 | 2.0 | => |
| 65.1 | 68.1 | 4.2 | 2.0 | <= |
| 66.1 | 68.9 | 3.8 | 2.0 | => |
| 66.9 | 69.5 | 3.4 | 2.0 | <= |
| 67.5 | 70.0 | 3.1 | 2.0 | => |
| 68.0 | 70.4 | 2.9 | 2.0 | <= |
| 68.4 | 70.7 | 2.7 | 2.0 | => |
| 68.7 | 71.0 | 2.6 | 2.0 | <= |
| Average temperature change (Delta Temp.) = 3.1° C. | | | | |

TABLE 2

THE DEFAULT CASE

| Start Temp. | End Temp. | Delta Temp. | | Direction |
|---|---|---|---|---|
| 55.0 | 60.0 | Max. | Min. | => |
| 55.0 | 60.0 | 5.0 | 5.0 | <= |
| 55.0 | 60.0 | 5.0 | 5.0 | => |
| 55.0 | 60.0 | 5.0 | 5.0 | <= |
| 55.0 | 60.0 | 5.0 | 5.0 | => |
| 55.0 | 60.0 | 5.0 | 5.0 | <= |
| 55.0 | 60.0 | 5.0 | 5.0 | => |
| 55.0 | 60.0 | 5.0 | 5.0 | <= |
| 55.0 | 60.0 | 5.0 | 5.0 | => |
| 55.0 | 60.0 | 5.0 | 5.0 | <= |
| 55.0 | 60.0 | 5.0 | 5.0 | => |
| 55.0 | 60.0 | 5.0 | 5.0 | <= |
| Average temperature change (Delta Temp.) = 5.0° C. | | | | |

Figure 5A:
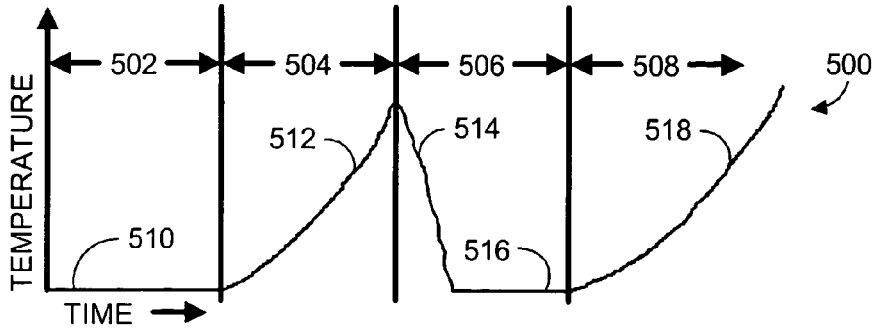
FIG. 5A is a graph illustrating operation of one example system.
Figure 5B:
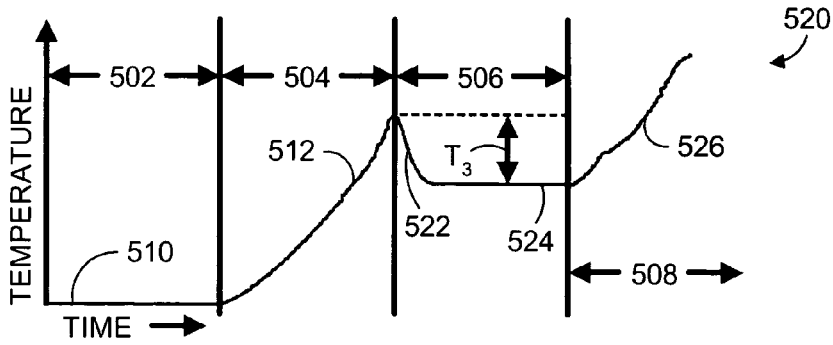
FIG. 5B is a graph illustrating operation of one embodiment of FIG. 4.
Figure 5C:
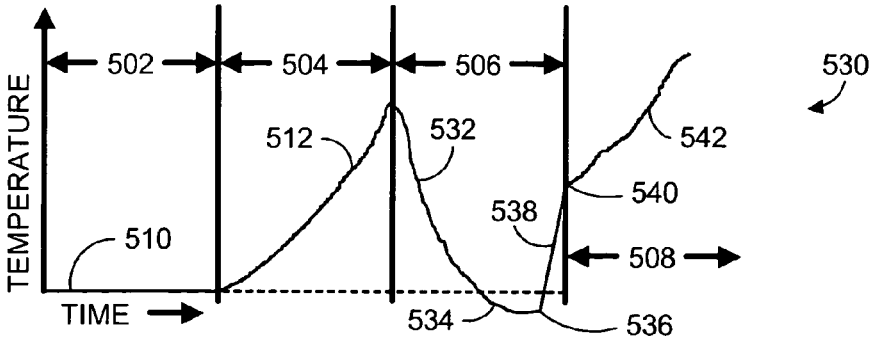
FIG. 5C is a graph illustrating operation of the alternate embodiment of FIG. 4.

FIGS. 5A and 5B illustrate the Default Case of Table 2, and the Temperature Limiting Warming System of Table 1, respectively, during the first print swath (X=1) and at the beginning of the second print swath (X=2). In FIG. 5A, a time vs. temperature graph 500 is shown as having four time periods: a warming period 502, a first swath printing period 504, a turnaround time period 506, and a second swath printing period 508 (these same time periods 502–508 are also shown in FIGS. 5B and 5C, although the temperature traces for time periods 506 and 508 vary as described further below). During the warming period 502, the printhead is brought to and held at an initial pre-warm temperature $T_1$, here for the purposes of illustration as 50° C. which is shown as trace (graph portion) 510, as conducted by the pre-warming operation 406 of FIG. 4. For the purposes of discussion and comparison, during the first swath printing time period 504, the temperature rises as shown in trace 512 to an end of swath printhead temperature $T_2$ which is equal to 60° C. in this example. Trace 510 for the initial pre-warming cycle and trace 512 for the first swath cycle are the same in FIGS. 5B and 5C.

In one example shown in graph 500 of FIG. 5A, during the turnaround time period 506, the printhead 122 cools toward ambient temperature as shown in trace 514, but is limited to the same initial pre-warm temperature $T_1$ at trace 516, which is apparent from a comparison of traces 510 and 516. During the next time period 508 where printing of the second swath begins, the temperature rise is shown as trace 518, which roughly resembles trace 512. From a quick glance back at Table 2, it is apparent that this cooling down to the initial temperature level of trace 516 and rise along traces similar to 512 and 518 during printing of each swath continues to repeat during the entire print job of request 130.

FIG. 5B illustrates a time vs. temperature graph 520 for the Temperature Limited Warming System 440 of FIG. 4, where the cooling temperature $T_3$ is held to a fixed value above the initial pre-warming temperature value $T_1$ of trace 510 during the turnaround time period 506. The end of previous print swath temperature $T_2$ is at the juncture of the swath printing time period 504 and the turnaround time period 506 (at the first peak) in each of FIGS. 5A–5C. As shown in FIG. 5B, printhead cool down occurs during trace 522. The selected base temperature for the next swath $T_{N-X}$ is established at trace 524, with the printhead(s) 122 not being allowed to drop in temperature beyond $T_{N-X}$, which is well above the initial pre-warming temperature $T_1$ of trace 510 (compare FIGS. 5A and 5B during time period 506, which occurs during the turnaround cooling delay operation 412 of FIG. 4). Printing of the next (second) swath is then shown at trace 526. This process continues as shown in Table 1 above for the rest of the print swaths until the final print swath N is completed and the print job concludes at operation 428.

Thus, in the illustrated example, rather than dropping back to the Default Case base temperature $T_1$ (also the initial example temperature) of 55° C., which is a 5° C. (=$T_2$−$T_3$) temperature difference ("Delta Temp.") this rule-based system sets a closer value $T_{N-X}$ for the printhead temperature on the next print swath, here, 2° C. By decreasing the printhead temperature difference between the end of one swath and the beginning of the next swath in a bi-directional print mode, the change in droplet weight is minimized, and visually observable banding print artifacts along each edge of the produced image are dramatically reduced.

While the Temperature Limited Warming System has its appeals, the eventual printhead temperature increase over printing a page (or several or many pages, such as when printing posters on large format inkjet printers, often referred to as plotters, using media which may range in width from 36–48 inches, or in the metric system, 91–121.92 centimeters) may push a printhead to a higher average temperature, and then inadvertently enact the overheating restriction operation of the cool down delay time operation 420, triggering a thermal slowdown of printing and slowing throughput while the printhead(s) 122 cools. For instance, during a twelve swath print job as shown in Table 2, beginning with an initial pre-warming temperature of 55° C., the final printhead temperature is 71° C. In contrast, for the Default Case of Table 3 the final temperature is 60° C., which is also the maximum temperature ever reached, yet banding occurs with the Default Case. Another variation on the Temperature Limited Warming System is discussed below.

B. Lower Power Warming System

Another rule-based pen warming system, referred to herein as a Lower Power Warming System 450 may be considered to be an enhancement to the Temperature Limited Warming System described above. In the Lower Power System 450, each printhead 122 is allowed to cool during most of the turnaround time between print swaths. Just prior to the start of printing the next swath, the trickle warming system 126 is instructed by controller 110 to activate the heater array system 128 to pre-warm each pen to a target base temperature. For example, pre-warming may start during the last 50–90% of a turnaround time period, or more preferably during the last 70–80% of a turnaround time period. The target base temperature $T_{N-X}$ may be determined in the same manner as described above for the Temperature Limited System 440, for instance, at a set amount lower than the ending temperature ($T_2$) of the previous swath. In contrast to the default case were the cooling temperature is limited to a set point, 55° C. in the example under consideration, with the Lower Power System 450, no minimum is set for the cooling temperature but prior to start up, the pen is given a jolt of pre-warming power to reach the target base temperature $T_{N-X}$.

As illustrated in FIG. 5C, during turnaround time period 506, trace 532 shows the cooling temperature dropping below the initial first swath start temperature $T_1$, as shown at trace 534 with the help of a dashed line extending horizontally from trace 510 to indicate this drop below the initial first swath pre-warming temperature $T_1$. Before the beginning of the next print swath, at graph point 536, the printhead 122 is jolted with a pre-warming current pulse sufficient to drive the temperature along trace 538 to the base temperature $T_{N-X}$ at graph point 540, and thereafter printing, the second swath as shown at trace 542.

In this Lower Power System 450, the total of amount of energy provided to the printhead(s) 122 during a print job is reduced from that experienced using the Temperature Limited System 440, yielding lower average and maximum printhead temperatures. Recall with the Temperature Limited System 440, the printhead temperature is held at the stepped starting temperature ($T_{N-X}=T_2-T_3$) of the next print swath, whereas in contrast, the Lower Power System 450 approach allows the pen to cool to a temperature, such as at graph point 536, which may be lower than the base starting temperature (e.g., trace 510) of the initial or previous print swath. Similarly in the Default Case trace 500, the printhead temperature is only allowed to decrease to the base starting temperature (e.g. 55° C.), while the Lower Power System 450 approach (graph 530) may allow the pen temperature to cool beneath this value, for example, to 50–54° C. or lower, before receiving a jolt of start-up energy as shown for trace 538. In practice, turnaround times between print swaths are often very short, so the relative benefits between using the Temperature Limited System versus using the Lower Power System may depend upon the specific implementation employed.

IV. Conclusion

In conclusion, with the system and method of the present invention, a dynamic system is established through a temperature sensor feedback system to maintain the relevant sections of the printhead substrate at temperatures within the limits of printhead target temperatures as described above. The net effect of this invention is the image produced on print media has visually unnoticeable print quality banding artifacts.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

The invention claimed:

1. A printing system, comprising:

an inkjet printhead configured to traverse bi-directionally over a printzone printing one swath in a first direction, and a subsequent swath in a second direction opposite the first direction, with the printhead rising to a base temperature in response to a pre-warming signal prior to beginning each swath;

a temperature sensor configured to monitor a temperature of the printhead; and a controller configured to generate the pre-warming signal in response to an end of swath temperature monitored by the temperature sensor following conclusion of printing the one swath, wherein the controller sets the base temperature for printing the one swath at a first temperature, and the base temperature for printing the subsequent swath at a second temperature above the first temperature, and wherein the second temperature is a fixed value.

2. The printing system of claim 1, wherein the fixed value is 0.50°–3.50° C. above the first temperature.

3. The printing system of claim 1, wherein the fixed value is about two degrees Celsius above the first temperature.

4. A printing system, comprising:

an inkjet printhead configured to traverse bi-directionally over a printzone printing one swath in a first direction, and a subsequent swath in a second direction opposite the first direction, with the printhead rising to a base temperature in response to a pre-warming signal prior to beginning each swath;

a temperature sensor configured to monitor a temperature of the printhead; and a controller configured to generate the pre-warming signal in response to an end of swath temperature monitored by the temperature sensor following conclusion of printing the one swath, wherein the controller sets the base temperature for printing the one swath at a first temperature, and the base temperature for printing the subsequent swath at a second temperature above the first temperature, and wherein the system allows the printhead temperature to drop to a third temperature below the first temperature prior to printing the subsequent swath.

5. The printing system of claim 4, wherein the controller is configured to generate the pre-warming signal to elevate the printhead temperature from the third temperature to the second temperature prior to printing the subsequent swath.

6. A printing system, comprising:

an inkjet printhead configured to traverse bi-directionally over a printzone printing one swath in a first direction, and a subsequent swath in a second direction opposite the first direction, with the printhead rising to a base temperature in response to a pre-warming signal prior to beginning each swath;

a temperature sensor configured to monitor a temperature of the printhead; and a controller configured to generate the pre-warming signal in response to an end of swath temperature monitored by the temperature sensor following conclusion of printing the one swath, wherein the controller is configured to generate the pre-warming signal to set the base temperature for printing the one swath at a first temperature, and the base temperature for printing the subsequent swath at a second temperature above the first temperature, with the second temperature being a fixed value less than the end of swath temperature for the one swath.

7. The printing system of claim 6, wherein the printhead temperature between printing the one swath and the subsequent swath is held at the second temperature prior to printing the subsequent swath.

8. The printing system of claim 6, wherein prior to printing the subsequent swath the printhead temperature is allowed to drop to a third temperature below the first temperature.

9. The printing system of claim 8, wherein prior to printing the subsequent swath, the controller is configured to generate the pre-warming signal to elevate the printhead temperature from the third temperature to the second temperature.

10. A printing system, comprising:

means for ejecting ink droplets bi-directionally over a printzone when printing one swath in a first direction, and a subsequent swath in a second direction opposite the first direction;

means for monitoring temperature of the means for ejecting; and means for setting a base temperature prior to beginning a subsequent swath in response to an end of swath temperature monitored by the means for monitoring, wherein the means for setting sets the base temperature for printing the one swath at a first temperature, and the base temperature for printing the subsequent swath at a second temperature above the first temperature, with the second temperature being a fixed value less than the end of swath temperature for the one swath.

11. The printing system of claim 10, further comprising means for holding the printhead temperature between printing the one swath and the subsequent swath at the second temperature prior to printing the subsequent swath.

12. The printing system of claim 10, wherein the printhead temperature drops to a third temperature below the first temperature before activation of the means for setting.

13. The printing system of claim 12, wherein prior to printing the subsequent swath, the means for setting elevates the printhead temperature from the third temperature to the second temperature.

14. A method for printing with an inkjet printhead bi-directionally over a printzone by printing one swath in a first direction and a subsequent swath in a second direction, comprising:

printing the one swath;

monitoring the temperature of the printhead;

in response to a monitored end of swath temperature following conclusion of printing the one print swath, changing the printhead temperature to a base temperature prior to beginning printing of the subsequent swath, wherein the changing sets the base temperature for printing the one swath at a first temperature, and the base temperature for printing the subsequent swath at a second temperature above the first temperature, and wherein the second temperature is a fixed value; and printing the subsequent swath.

15. The method of claim 14, wherein the changing is conducted in accordance with a rule-based system.

16. A method for printing with an inkjet printhead bi-directionally over a printzone by printing one swath in a first direction and a subsequent swath in a second direction, comprising:

printing the one swath;

monitoring the temperature of the printhead;

in response to a monitored end of swath temperature following conclusion of printing the one print swath, changing the printhead temperature to a base temperature prior to beginning printing of the subsequent swath, wherein the changing sets the base temperature for printing the one swath at a first temperature, and the base temperature for printing the subsequent swath at a second temperature above the first temperature;

allowing the printhead temperature to drop to a third temperature below the first temperature prior to printing the subsequent swath; and printing the subsequent swath.

17. The method of claim 16, wherein the changing comprises elevating the printhead temperature from the third temperature to the second temperature prior to printing the subsequent swath.

18. An inkjet printing mechanism, comprising:

a carriage configured to traverse bi-directionally over a printzone;

an inkjet printhead supported by the carriage to print one swath in a first direction, and a subsequent swath at a second direction opposite the first direction, with the printhead rising to a base temperature in response to a pre-warming signal prior to beginning each swath;

a temperature sensor configured to monitor temperature of the printhead; and a controller configured to generate the pre-warming signal in response to an end of swath temperature monitored by the temperature sensor following conclusion of printing the one swath, wherein the controller generates the pre-warming signal to set the base temperature for printing the one swath at a first temperature, and the base temperature for printing the subsequent swath at a second temperature above the first temperature, with the second temperature being a fixed value less than the end of swath temperature for the one swath.

19. The inkjet printing mechanism of claim 18, wherein the printhead temperature between printing the one swath and the subsequent swath is held at the second temperature prior to printing the subsequent swath.

20. The inkjet printing mechanism of claim 18, wherein prior to printing the subsequent swath the printhead temperature drops to a third temperature below the first temperature.

21. The inkjet printing mechanism of claim 20, wherein prior to printing the subsequent swath, the controller generates the pre-warming signal to elevate the printhead temperature from the third temperature to the second temperature.

* * * * *